US006830478B1

(12) United States Patent
Ko

(10) Patent No.: US 6,830,478 B1
(45) Date of Patent: Dec. 14, 2004

(54) MICRO COAXIAL CONNECTOR ASSEMBLY WITH LATCHING MEANS

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/733,075

(22) Filed: Dec. 10, 2003

(51) Int. Cl.[7] ..... H01R 9/05

(52) U.S. Cl. ..... 439/579; 439/497; 439/610; 439/484

(58) Field of Search ..... 439/579, 497, 439/610, 484

(56) References Cited

U.S. PATENT DOCUMENTS 5,980,308 A * 11/1999 Hu et al. ..... 439/497
6,059,604 A * 5/2000 Juntwait et al. ..... 439/497
6,123,582 A * 9/2000 Ko et al. ..... 439/579
6,152,771 A * 11/2000 Juntwait ..... 439/607
6,273,753 B1 * 8/2001 Ko ..... 439/579
6,305,978 B1 * 10/2001 Ko et al. ..... 439/579
6,305,979 B1 * 10/2001 Ko ..... 439/579
6,319,049 B1 * 11/2001 Lee ..... 439/484
6,338,652 B1 * 1/2002 Ko ..... 439/579
6,416,353 B1 * 7/2002 Hwang et al. ..... 439/484
6,416,354 B1 * 7/2002 Lee ..... 439/484
6,500,013 B1 * 12/2002 Wang ..... 439/108
6,544,050 B1 * 4/2003 Ko ..... 439/108
6,619,985 B1 * 9/2003 Ko ..... 439/607
6,634,894 B1 * 10/2003 Ko ..... 439/108
6,641,435 B1 * 11/2003 Ko ..... 439/579
6,645,007 B1 * 11/2003 Ko ..... 439/579
6,648,668 B1 * 11/2003 Ko ..... 439/353
6,655,992 B1 * 12/2003 Ko ..... 439/579
6,659,791 B1 * 12/2003 Ko et al. ..... 439/353
6,676,444 B2 * 1/2004 Noro ..... 439/579
6,685,495 B1 * 2/2004 Ko ..... 439/353
6,705,893 B1 * 3/2004 Ko ..... 439/607
6,705,896 B1 * 3/2004 Chang et al. ..... 439/610
6,749,458 B1 * 6/2004 Kuo et al. ..... 439/484
6,755,687 B1 * 6/2004 Ko ..... 439/579

FOREIGN PATENT DOCUMENTS

JP 1170052 2/2003

* cited by examiner

*Primary Examiner*—Ross Gushi
(74) *Attorney, Agent, or Firm*—Wei Te Chung

(57) ABSTRACT

A connector assembly (100) includes a first connector (200) and a second connector (300). The first connector includes a first housing (1) including a mating portion (10) opening in a first direction, a number of first contacts (2), a number of leads (3) electrically connecting with the first contacts in a second direction, and a first grounding member (5) including a first grounding shield (50) and a second grounding shield (52) electrically connecting with each other. The second grounding shield includes a second body portion (520) and a second vertical portion (526) extending from the second body portion in the first direction. The second connector includes a second housing (7), a number of second contacts (72), a second grounding member (9) enclosing the second housing, and a second pulling member (8). The second vertical portion of the second grounding shield exerts a pressing force on the second grounding member in the second direction and is circled by the second pulling member.

21 Claims, 10 Drawing Sheets

MICRO COAXIAL CONNECTOR ASSEMBLY WITH LATCHING MEANS

BACKGROUND OF THE INVENTION

1. Field of the Invention

The present invention generally relates to a connector assembly, and more particularly to a micro coaxial connector assembly with latching means.

2. Description of Related Art

Micro coaxial connector assembly is usually used for connecting a mother board and a Liquid Crystal Display (LCD) and comprises a cable connector assembly and a header connector mounted on the mother board. The cable connector assembly comprises a first housing receiving a plurality of first contacts, a plurality of signal and power conductors electrically connecting with the first contacts along a direction perpendicular to the first housing, a first grounding member enclosing the first housing and electrically connecting with the conductors, and a pulling member assembled to the first housing for separating the cable connector assembly from the head connector. The header connector comprises a second housing receiving a plurality of second contacts, a second shielding member enclosing the second housing. The first contacts respectively electrically connect with the second contacts to form electrical connection between the cable connector and the head connector.

In use, the LCD opens and closes relative to the mother board frequently, and shock and vibration may often occur. Thus, the mating condition between the cable connector assembly and the head connector is not stable without a latching means.

Hence, a micro coaxial connector assembly with latching means is highly desired to overcome the disadvantages of the prior art.

SUMMARY OF THE INVENTION

Accordingly, an object of the present invention is to provide an improved micro coaxial connector assembly which comprising a pair of complementary connectors latching with each other reliably.

In order to achieve the object set forth, a connector assembly in accordance with the present invention comprises a first connector and a second connector mating with the first connector. The first connector comprises a first housing comprising a mating portion defining a receiving cavity opening in a first direction and a base perpendicular to the mating portion, a plurality of first contacts received in the first housing, a plurality of leads electrically connecting with the first contacts in a second direction, a plurality of solder slugs located between the first contacts and the leads and a first grounding member comprising a first grounding shield and a second grounding shield electrically connecting with each other. The second connector comprises a second housing comprising a shroud portion and a tongue portion received in the receiving cavity, a plurality of second contacts received in the second housing and electrically connecting with the first contacts, and a second grounding member enclosing the shroud portion. The second grounding shield of the first grounding member comprises a second body portion and a second vertical portion extending from the body portion in the first direction and exerting a pressing force on the second grounding member in the second direction.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
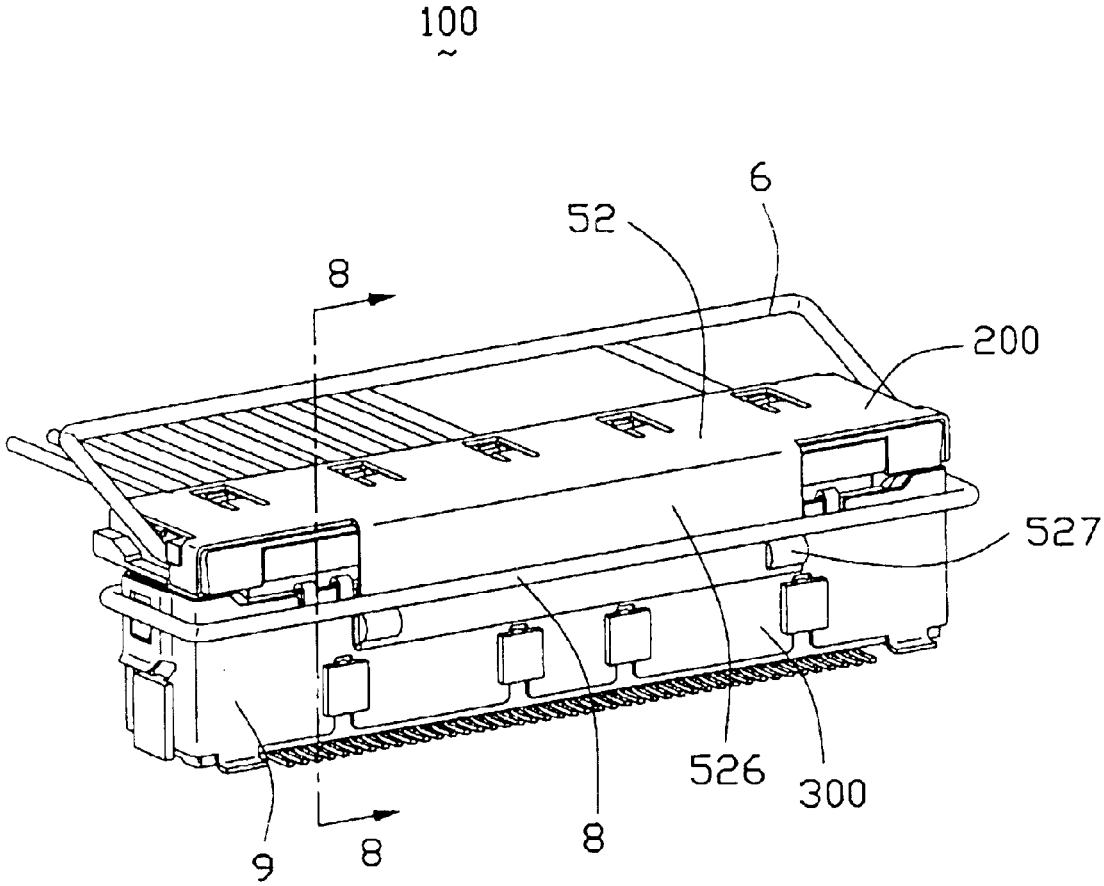
FIG. 1 is an assembled view of a connector assembly in accordance with the present invention.
Figure 2:
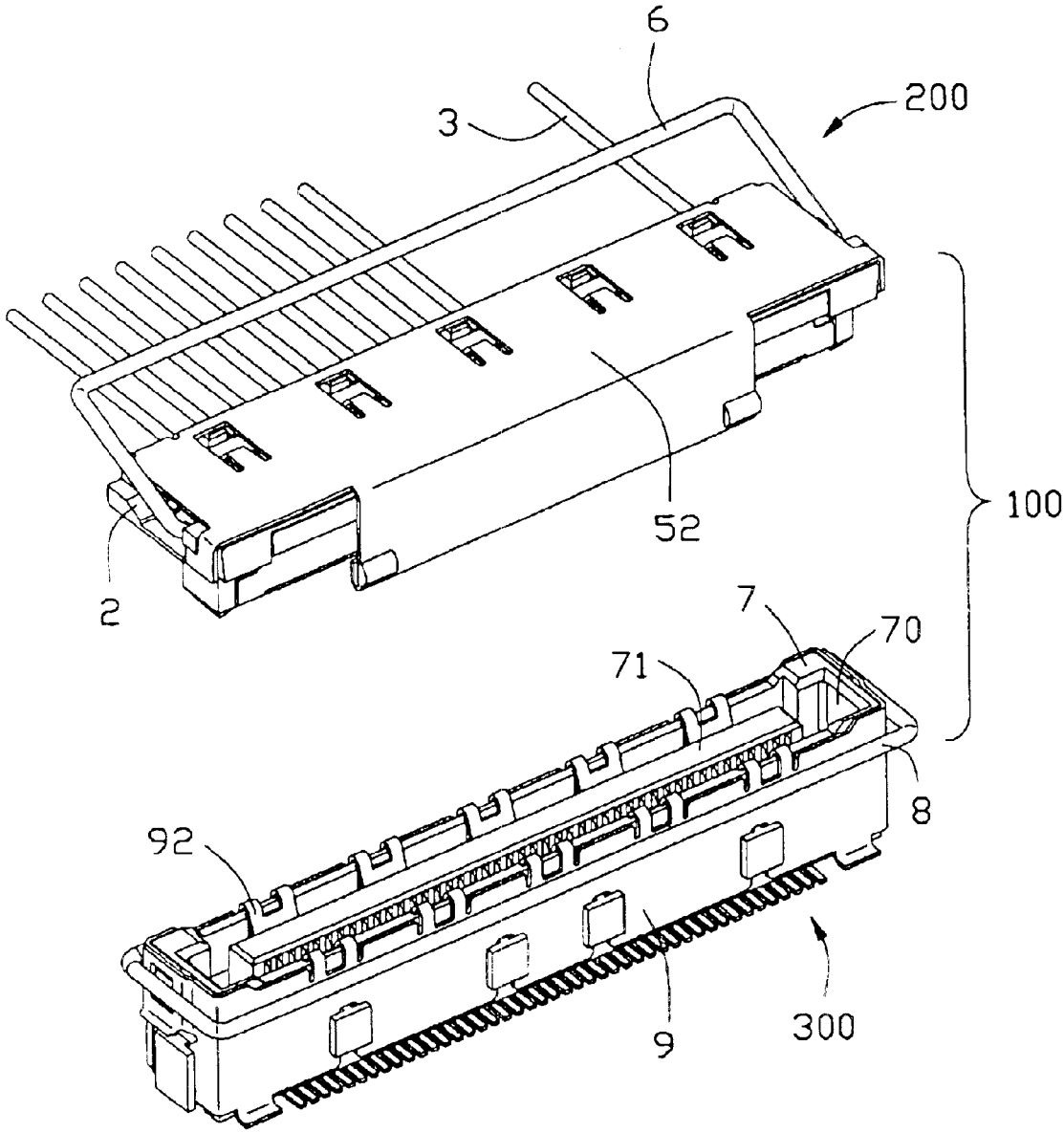
FIG. 2 is an exploded, perspective view of FIG. 1.
Figure 3:
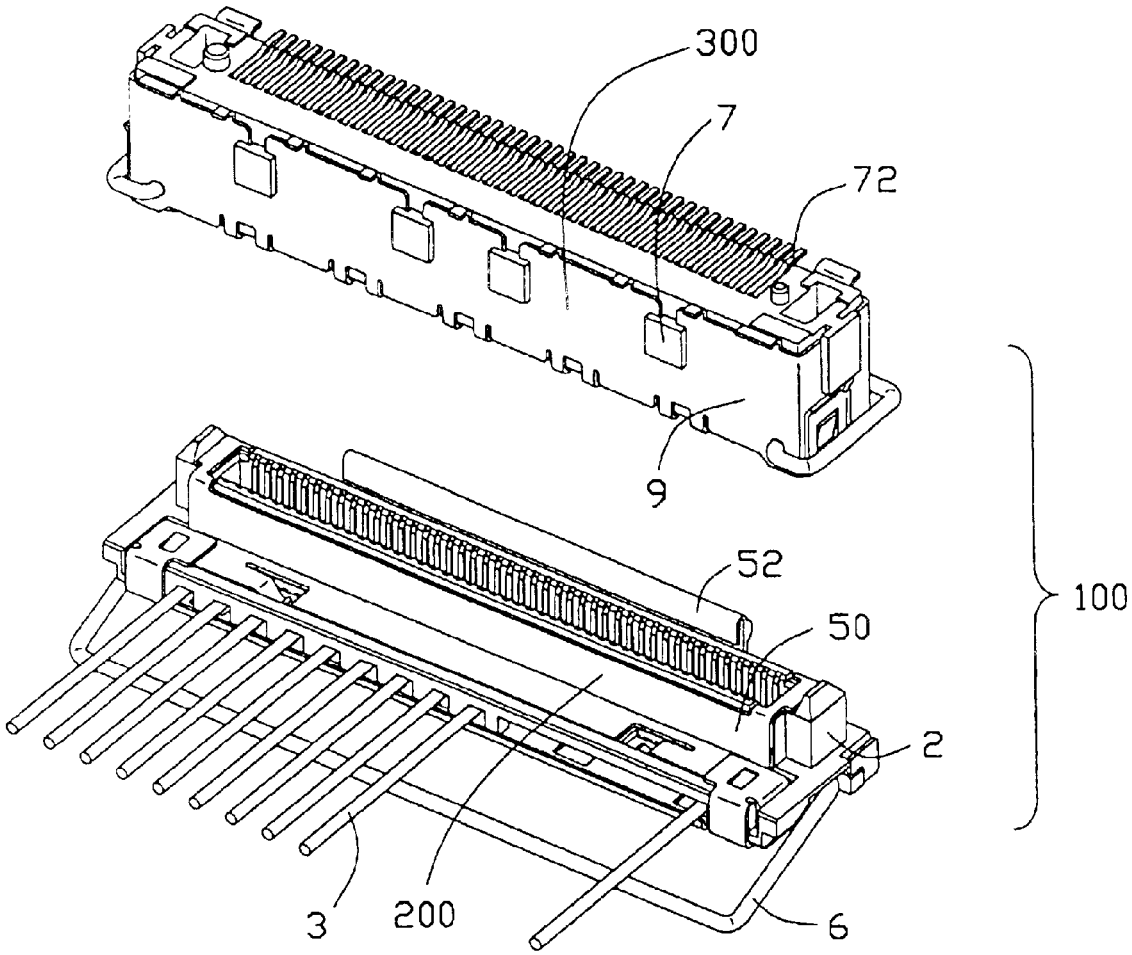
FIG. 3 is a view similar to FIG. 2, but taken from a different aspect.

Referring to FIGS. 1-3, a connector assembly 100 in accordance with the present invention comprises a first connector 200 and a second connector 300 mating with the first connector 200.

Figure 4:
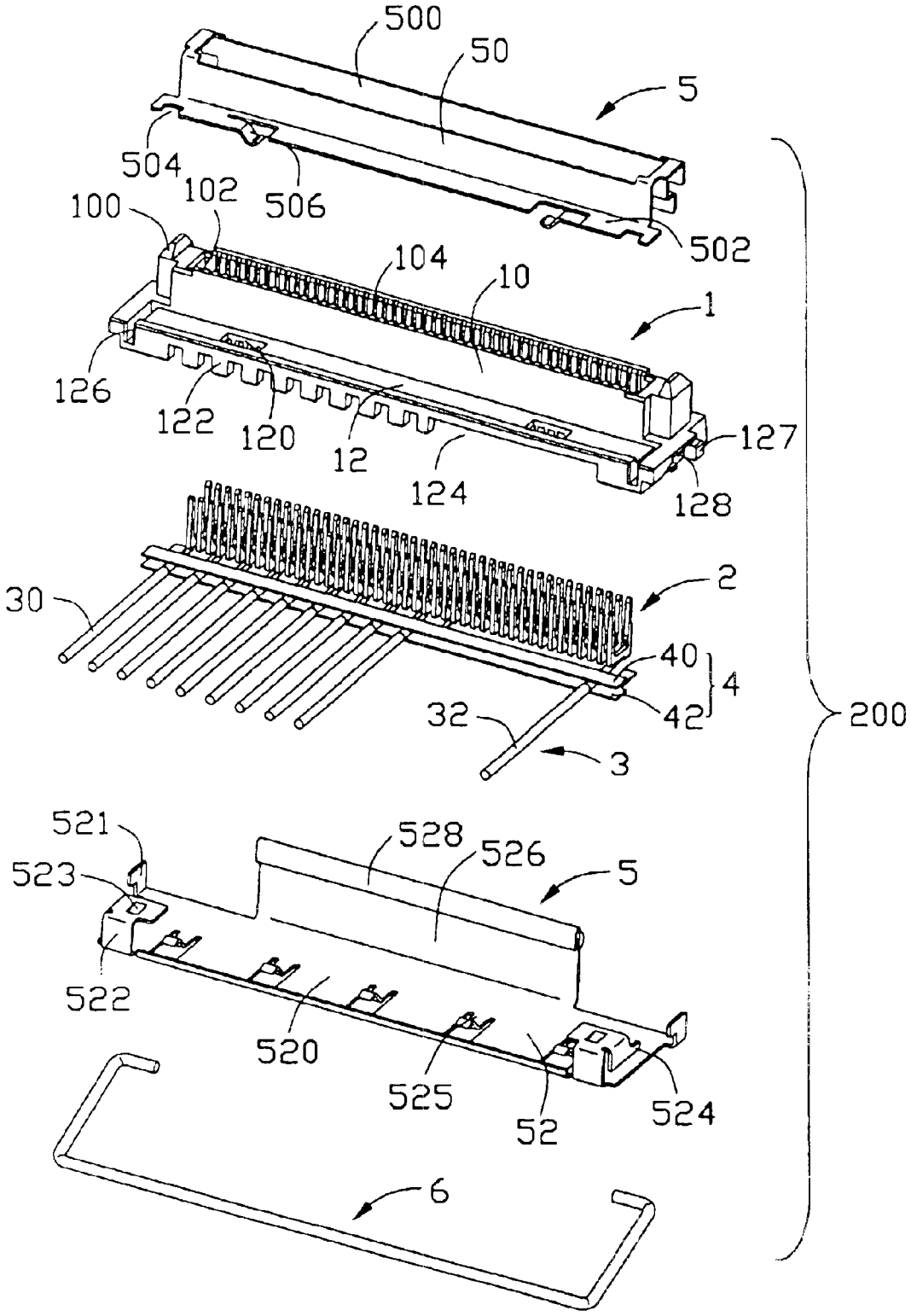
FIG. 4 is a partially exploded, perspective view of a first connector of the connector assembly in accordance with the present invention.
Figure 5:
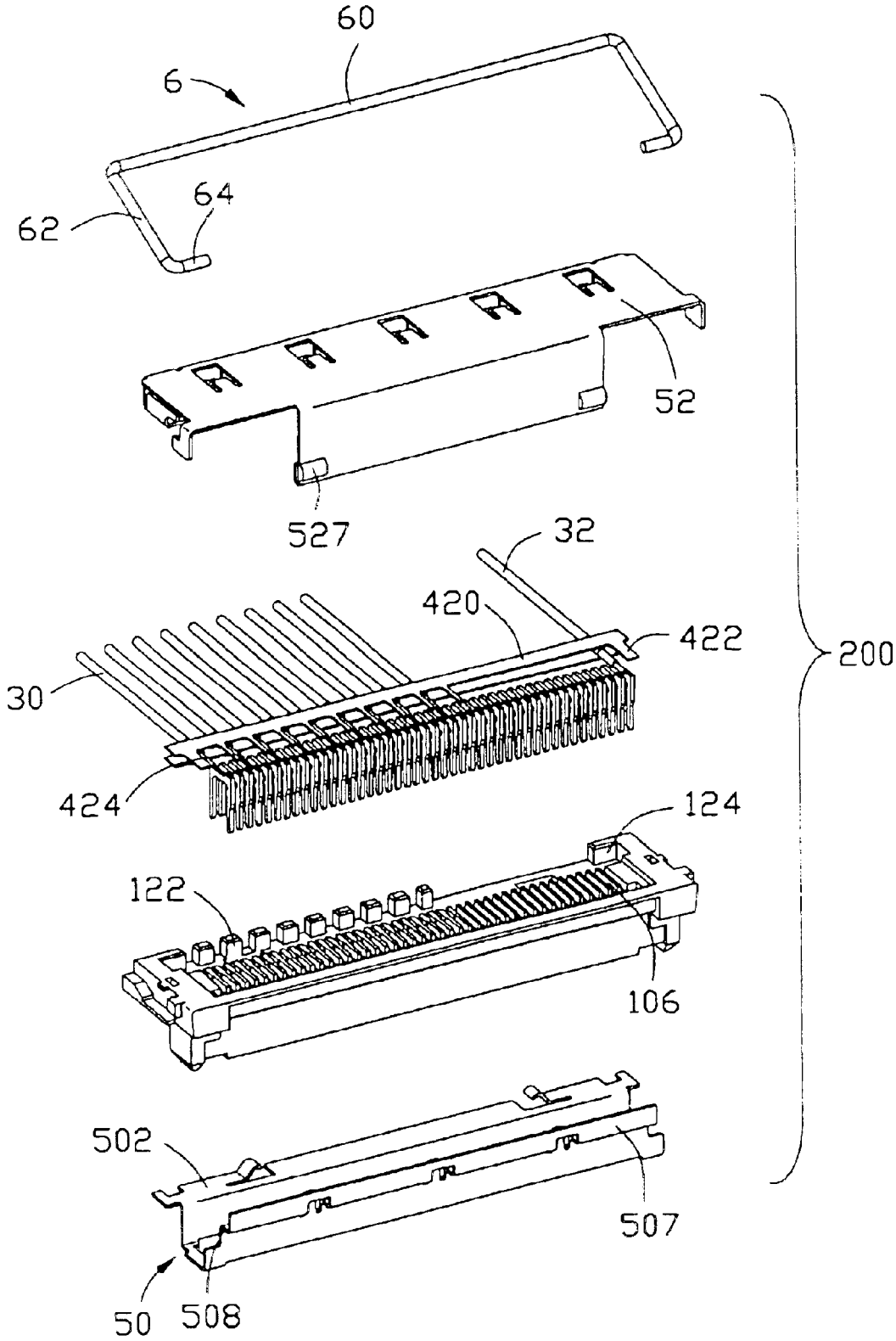
FIG. 5 is a view similar to FIG. 4, but taken from a different aspect.

Referring to FIGS. 4-5 in conjunction with FIGS. 2-3, the first connector 200 comprises a first insulative housing 1, a plurality of first conductive contacts 2 respectively received in the first insulative housing 1, a plurality of leads 3 electrically connecting with the first conductive contacts 2, a grounding element 4, a first grounding member 5 assembled to the first insulative housing 1, and a first pulling member 6.

The first insulative housing 1 is substantially elongated and comprises a base 12 and a mating portion 10 protruding downwardly from the base 12. A pair of guiding posts 100 are respectively formed on opposite ends of the mating portion 10 for guiding proper insertion of the second connector 300. A receiving cavity 102 is recessed upwardly from a lower surface of the mating portion 10. The base 12 defines a plurality of canals 106 in an upper portion thereof. A cutout 124 is defined in the upper portion of the base 12 and is recessed downwardly from the canals 106. A plurality of extrusions 122 is formed on the upper portion of the base 12 to form a plurality of grooves. A pair of recesses 120 extend through a rear side of the base 12 and a pair of slots 126 is respectively defined in the base 12 adjacent to opposite lateral ends of the base 12. A pair of protrusions 127 respectively laterally protrude from the lateral ends of the base 12. A first receiving hole 128 is defined laterally in the base 12 adjacent to a corresponding protrusion 127. A plurality of passages 104 are respectively defined in opposite inner surfaces of the mating portion 10 to communicate with the canals 106.

Figure 8:
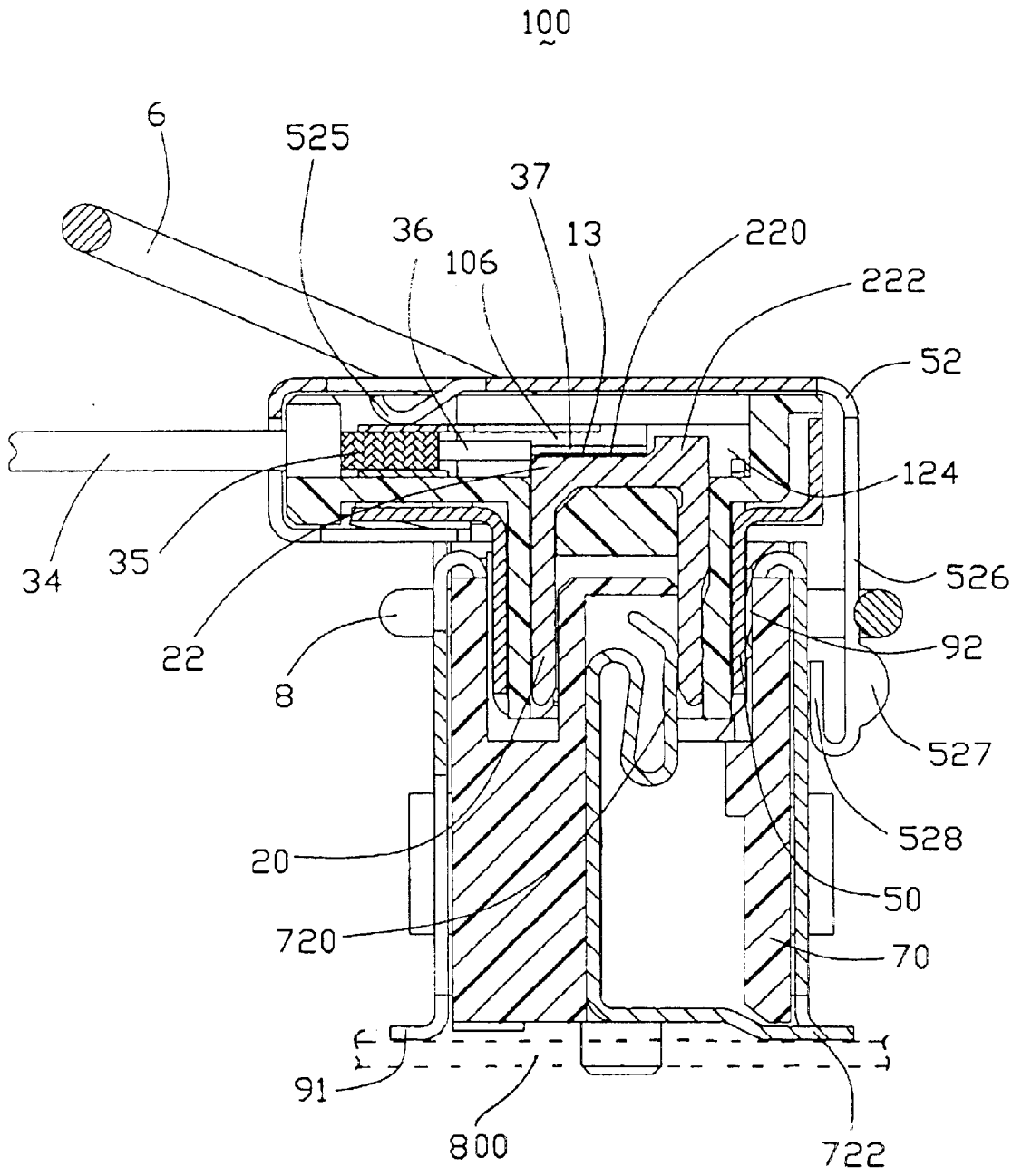
FIG. 8 is a cross-sectional view of FIG. 1 taken along line 8—8.

Particularly referring to FIG. 8, the first conductive contact 2 is substantially U-shaped and comprises a pair of first contacting portions 20 and a first soldering portion 22 interconnecting the pair of first contacting portions 20. The first soldering portion 22 is formed with an extrusion 222 extending upwardly from a soldering surface 220 thereof.

Referring to FIGS. 4-5 in conjunction with FIG. 8, the leads 3 comprise a group of first wires 30 for signal transmission and a group of second wires 32 for power transmission. Each lead 3 comprises a pair of conductors 37 arranged as a differential pair, an insulative layer 36 enclosing the conductors 37, a metal braiding 35 enclosing the insulative layer 36 and an outer jacket (not labeled) enclosing the metal braiding 35.

Referring to FIGS. 4-5, the grounding element 4 comprises a first grounding bar 40 and a second grounding bar 42. The first grounding bar 40 is a flat plate. The second grounding bar 42 comprises a body portion 420, a pair of strips 422 extending forwardly from opposite sides of the body portion 420, and a plurality of grounding fingers 424 formed between the pair of strips 422.

The first grounding member 5 comprises a first grounding shield 50 and a second grounding shield 52. The first grounding shield 50 generally has a U-shaped configuration and comprises a U-shaped first body portion 500, a pair of first and second flanges 502, 508 respectively extending outwardly from opposite upper edges of the first body portion 500, and a first vertical portion 507 extending upwardly from the second flange 508. The first flange 502 defines a pair of openings 504 and a pair of spring tabs 506 are formed between the pair of openings 504 and extend toward each other.

The second grounding shield 52 generally has an L-shaped configuration and comprises a second body portion 520. A pair of buckling portions 521 form on a front portion of the second body portion 520 and extend vertically from opposite lateral edges of the second body portion 520. An L-shaped pressing portion 522 forms on a rear portion of the second body portion 520 and bends vertically from a rear edge of the second body portion 520. Each pressing portion 522 has a latch 524 extending forwardly from an outer side thereof and a press tab 523 bending upwardly from a top surface thereof. The second body portion 520 forms a plurality of spring arms 525 curved downwardly in the front portion thereof and a second vertical portion 526 bending downwardly from the front portion thereof. The vertical portion 526 forms a spring flake 528 on a lower end thereof and a pair of tubers 527 opposite to the spring flake 528 and spaced from each other.

Referring to FIGS. 4-5, the first pulling member 6 comprises a first pulling section 60, a pair of first arms 62 extending downwardly from opposite ends of the first pulling section 60, and a pair of first engaging sections 64 respectively extending vertically from corresponding first arms 62 and extending toward each other.

Referring to FIGS. 1-5 in conjunction with FIG. 8, in assembly, the first conductive contacts 2 are firstly assembled to the first insulative housing 1. The first contacting portions 20 of each first conductive contact 2 are respectively received in the passages 104. The first soldering portion 22 is received in the canal 106 of the base 12 with the extrusion 222 thereof exposed in the cutout 124. The first grounding bar 40 is positioned in the upper portion of the base 12. The conductors 37 of the first and the second wires 30, 32 are respectively contacting with the soldering surface 220 of the first soldering portions 22 and received in the canals 106. Free ends of the conductors 37 respectively abut against the extrusions 222 of the first soldering portions 22. The second grounding bar 42 is put on the leads 3 and the metal braidings 35 of the first and the second wires 30, 32 are electrically connecting with the first and the second grounding bars 40, 42. The grounding fingers 424 of the second grounding bar 42 are inserted in selected canals 106 to be soldered with respective grounding contacts (not labeled). In addition, a plurality of solder slugs 13 is provided between the first soldering portions 22 of the first contacts 2 and the conductors 37 of the first and the second wires 30, 32. When soldering the first and the second wires 30, 32 to the first conductive contacts 2, heat is supplied to the extrusions 222 of the first conductive contacts 2, and is conducted to other parts of the first soldering portions 22 to melt the solder slugs 13 for soldering the first and the second wires 30, 32 and the first conductive contacts 2 together.

The first grounding shield 50 is assembled to the insulative housing 2 in a mating direction of the first and the second connectors 200, 300. The first body portion 500 of the first grounding shielding 50 encloses the mating portion 10 of the first housing 1 with the first and the second flanges 502, 508 respectively located on the base 12. The pair of spring tabs 506 are respectively received in the recesses 120 of the first housing 1. The first vertical portion 507 covers a front side of the base 12. The second grounding shield 52 is also assembled to the first insulative housing 1. The second body portion 520 of the second grounding shield 52 encloses the upper portion of the base 12 with the spring arms 525 electrically connected with the second grounding bar 42. The pressing portions 522 press on the first flange 502 of the first grounding shield 50 and the latches 524 are securely received in the slots 126 of the first housing 1 with the press tab 523 received in the opening 504 of the first grounding shield 50 and abutting against the base 12. The buckling portions 521 respectively buckle to the protrusions 127 of the first housing 1 and the second vertical portion 526 extends beyond the mating portion 10 in the mating direction.

The first pulling member 6 is assembled to the first insulative housing 1 with the pair of first engaging sections 64 respectively received in the first receiving holes 128 of the first insulative housing 1.

Figure 6:
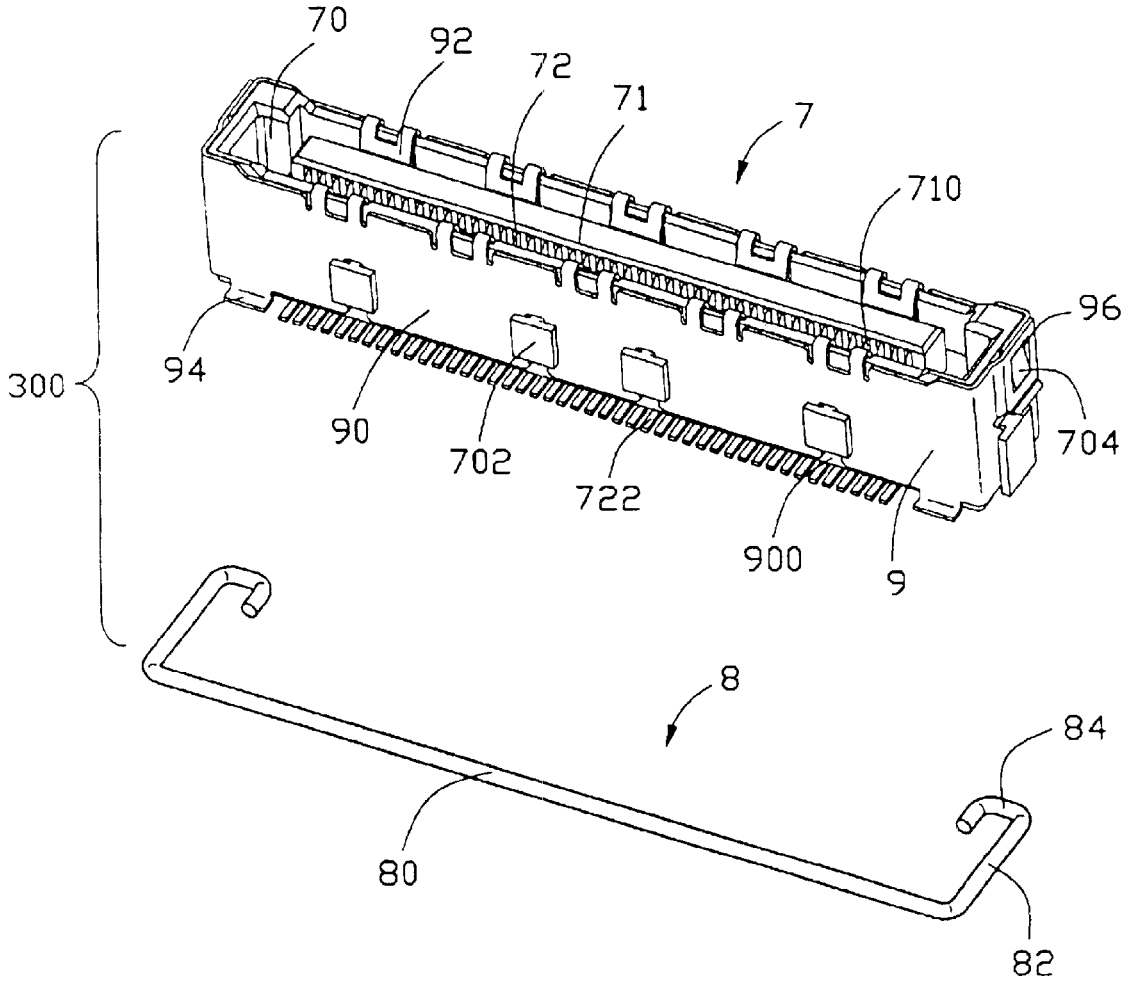
FIG. 6 is a partially exploded, perspective view of a second connector of the connector assembly in accordance with the present invention.
Figure 7:
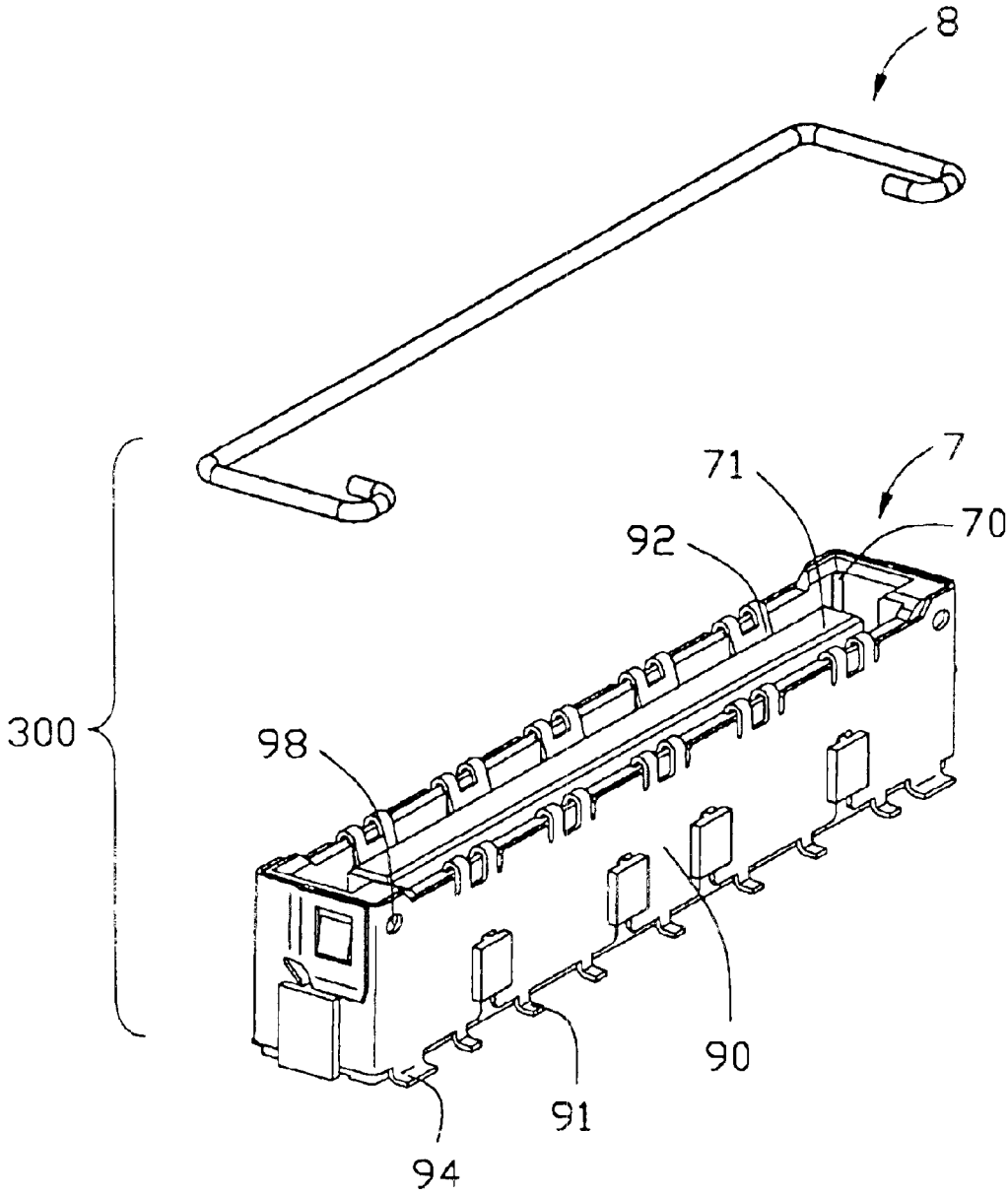
FIG. 7 is a view similar to FIG. 6, but taken from a different aspect.

Referring to FIGS. 6-8 in conjunction with FIGS. 1-3, the second connector 300 is usually mounted on a printed circuit board 800 and comprises a second insulative housing 7, a plurality of second conductive contacts 72 received in the second housing 7, a second grounding member 9 enclosing the second housing 7, and a second pulling member 8.

The second insulative housing 7 comprises a shroud portion 70 and a tongue portion 71 extending upwardly from a bottom of the shroud portion 70. A plurality of T-shaped projections 702 distribute on opposite longitudinal walls and opposite lateral walls of the shroud portion 70. A latch 704 forms on each lateral wall of the shroud portion 70 above a corresponding projection 702. The tongue portion 71 defines a plurality of passageways 710 on one of opposite surfaces thereof. Each second conductive contact 72 generally has an L-shaped configuration and comprises a curved second contacting portion 720 respectively received in the passageways 710 of the tongue portion 71 and a second soldering portion 722 extending vertically from the second contacting portion 720 and exposed beyond one of the opposite longitudinal walls of the shroud portion 70.

Continuing to FIGS. 6-7, the second pulling member 8 comprises a second pulling section 80, a pair of second arms 82 extending forwardly from opposite ends of the second pulling section 80, and a pair of L-shaped second engaging sections 84 respectively extending vertically from corresponding second arms 82 and extending toward each other.

The second grounding member 9 comprises a main body 90 enclosing the shroud portion 70. The main body 90 defines a plurality of openings 900 respectively engaging with the T-shaped projections 702 and a pair of apertures 96 respectively receiving the latches 704. A plurality of hooking portions 92 bends downwardly from longitudinal upper edges of the main body 90 and latch the opposite longitudinal walls of the shroud portion 70 for securing the second grounding member 9 to the second insulative housing 7. A pair of soldering pads 94 respectively extend outwardly from each longitudinal lower edge of the main body 90 for being soldered to the printed circuit board. For symmetrizing to the second soldering portions 722, a plurality of soldering legs 91 forms integrally with the main body 90 opposite to the second soldering portions 722. A pair of second receiving holes 98 are respectively defined through the second grounding member 9 and the second insulative housing 7 to receive the second engaging portions 84 of the second pulling member 8.

Referring to FIG. 8 in conjunction with FIGS. 1-3, in assembly of the connector assembly 100, the first connector 200 mates with the second connector 300 along the mating direction. The first contacting portions 20 of the first conductive contacts 2 electrically connect with the second contacting portions 720 of the second conductive contacts 72 with the tongue portion 71 received in the receiving cavity 102 of the mating portion 10. The first grounding shield 50 electrically connects with the hooking portions 92 of the second grounding member 9. The second vertical portion 526 of the second grounding shield 52 partially covers the second grounding member 9 with the second pulling member 8 circling the second vertical portion 526. The second pulling member 8 is just located above tubers 527 of the second grounding shield 52 for preventing the inadvertent separation of the first connector 200 from the second connector 300. The spring flake 528 elastically presses on the second grounding member 9 and the second vertical portion 526 can be pressed rearwardly for separating the first connector 200 from the second connector 300.

Figure 9:
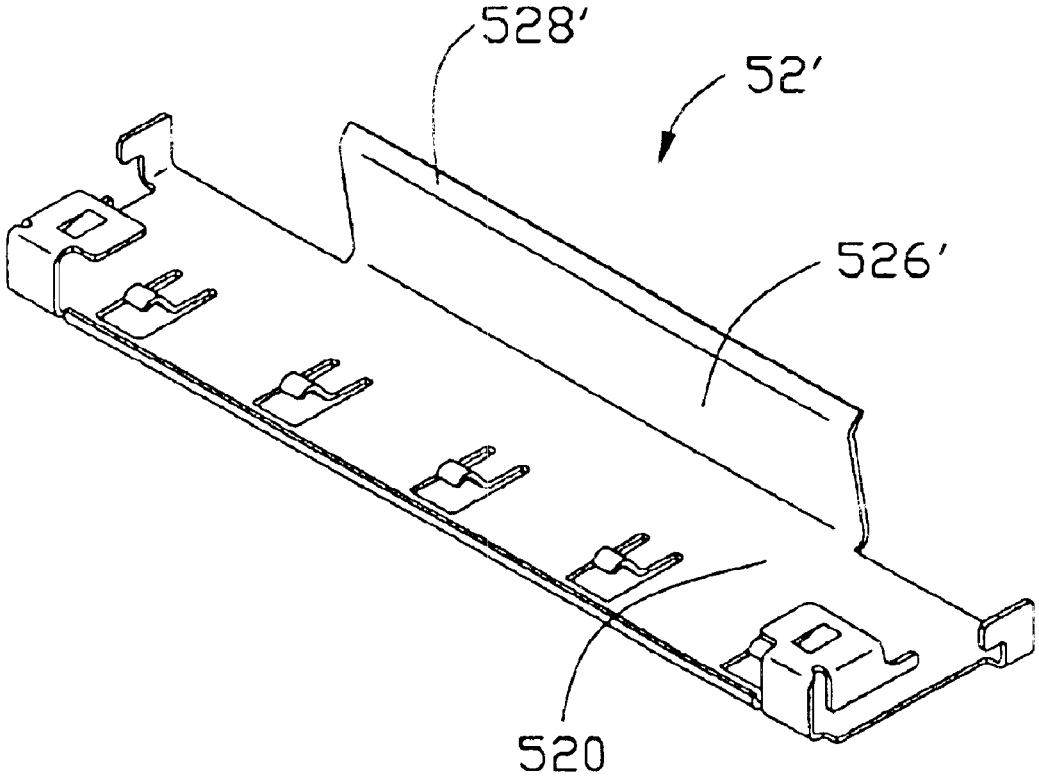
FIG. 9 is a perspective view of a second grounding shield of a first connector in accordance with the second embodiment.
Figure 10:
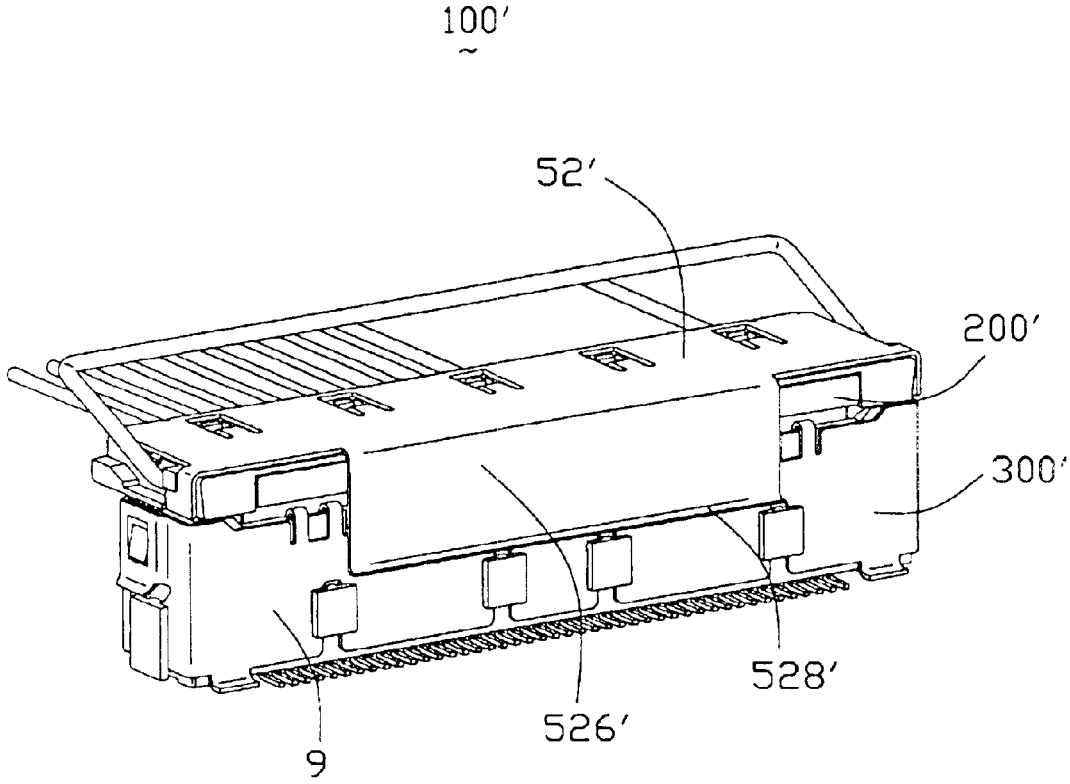
FIG. 10 is an assembled view of a connector assembly in accordance with the second embodiment.

FIGS. 9-10 illustrate a connector assembly 100' in accordance with the second embodiment. The connector assembly 100' comprises a first connector 200' and a second connector 300' mating with the first connector 200'. The first connector 200' has the same structure as that of the first connector 200 except for the second grounding shield 52'. A second vertical portion 526' extends vertically from the second body portion 520 and forms a curved edge 528' slightly bending outwardly. The second connector 300' has the same structure as that of the second connector 300 except that the second connector 300' does not have the second pulling member 8. A plurality of extrusions is formed on the second shielding member 9 to increase the friction between the second vertical portion 526' and the second shielding member 9.

In assembly of the connector assembly 100', the first connector 200' is assembled to the second connector 300' in the mating direction. The second vertical portion 526' partially covers the second shielding member 9 and the curved edge 528' presses on the second shielding member 9 for preventing the separation of the first connector 200' from the second connector 300'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly, comprising:

a first connector comprising:

a first insulative housing comprising a mating portion defining a receiving cavity opening in a first direction, a base perpendicular to the mating portion;

a plurality of first conductive contacts each comprising a first contacting portion received in the mating portion of the insulative housing and a first soldering portion;

a plurality of leads assembled to the base, each lead comprising a conductor electrically connecting with the soldering portion of a corresponding conductive contact in a second direction perpendicular to said first direction and a metal braiding surrounding the conductor;

a plurality of solder slugs each located between the first soldering portion of the first conductive contact and the conductor of the lead to solder the first conductive contact with the conductor; and a first grounding member comprising a first grounding shield assembled to the mating portion in said first direction and a second grounding shield assembled to the base in said second direction, the first and the second grounding shields being electrically connected with each other and electrically connecting with the metal braidings of the leads; and a second connector comprising:

a second insulative housing comprising a shroud portion and a tongue portion received in the receiving cavity of the first insulative housing;

a plurality of second conductive contacts respectively received in the second insulative housing and each comprising a second contacting portion electrically connecting with the first contacting portion of a corresponding first conductive contact and a second soldering portion adapted for being mounted to a printed circuit board; and a second grounding member enclosing the shroud portion of the second insulative housing, said second grounding shield of the first grounding member comprising a body portion and a vertical portion extending vertically from the body portion in said first direction and exerting a pressing force on the second grounding member in said second direction.

2. The connector assembly as claimed in claim 1, wherein the first conductive contact is U-shaped, and the second conductive contact is L-shaped.

3. The connector assembly as claimed in claim 1, wherein the base forms a protrusion, and wherein the second grounding shield forms a buckling portion engaging with the protrusion to secure the second grounding shield to the insulative housing.

4. The connector assembly as claimed in claim 1, wherein the base defines a recess, and wherein the first grounding shield comprises a spring tab received in the recess and electrically connecting with the metal braiding of the lead.

5. The connector assembly as claimed in claim 1, wherein the lead comprises a pair of conductors arranged as a differential pair.

6. The connector assembly as claimed in claim 1, wherein the leads are grouped into power transmitting wires and signal transmitting wires.

7. The connector assembly as claimed in claim 1, wherein the second insulative housing forms a plurality of protrusions, and wherein the second grounding member defines a plurality of openings respectively engaging with the protrusions for securing the second grounding member to the second insulative housing.

8. The connector assembly as claimed in claim 1, wherein the second grounding member forms a plurality of hooking portions latching with the shroud portion of the second insulative housing.

9. The connector assembly as claimed in claim 1, wherein the first connector further comprises a grounding element electrically connecting with the first grounding member and the metal braidings of the leads.

10. The connector assembly as claimed in claim 1, wherein the vertical portion of the second grounding shield forms a curved edge pressing on the second grounding member.

11. The connector assembly as claimed in claim 1, wherein the second connector further comprises a second pulling member engaging with the second grounding member and the second insulative housing in said second direction, and wherein the second pulling member circles the vertical portion of the second grounding shield.

12. The connector assembly as claimed in claim 11, wherein the vertical portion of the second grounding shield forms a tuber located below the second pulling member.

13. The connector assembly as claimed in claim 1, wherein the first connector further comprises a first pulling member assembled to the first insulative housing in the first direction.

14. The connector assembly as claimed in claim 13, wherein the first pulling member comprises a pair of first engaging sections assembled to the first insulative housing, a first pulling section parallel to the first engaging sections and a pair of arms interconnecting the first pulling section and the first engaging sections.

15. The connector assembly as claimed in claim 1, wherein the base of the first insulative housing defines a plurality of canals, and wherein the first soldering portions of the first conductive contacts and corresponding conductors of the leads are respectively received in the canals.

16. The connector assembly as claimed in claim 15, wherein the first soldering portion of the first conductive contact forms an extrusion exposed beyond the canal, and wherein the solder plug melts upon heating the extrusion of the first soldering portion to solder the first conductive contacts with the leads.

17. The connector assembly as claimed in claim 1, wherein the first grounding shield comprises a first flange located on the base, and wherein the second grounding shield comprises a pressing portion electrically connecting with the first flange.

18. The connector assembly as claimed in claim 17, wherein the base comprises a slot, and wherein the pressing portion of the second grounding shield has a latch securely received in the slot.

19. An electrical connector assembly comprising:

a first electrical connector including:

a first insulative housing having thereof a first mating port defining a mating direction;

a plurality of first conductive contacts disposed in the first insulative housing;

a plurality of wires respectively connected to the corresponding first conductive contacts and extending through a first side of the first insulative housing in a first direction angled relative to said mating direction;

a first grounding shield assembly assembled to said first insulative housing and including a vertical portion covering a second side of the first insulative housing, said second side being opposite to said first side; and a second electrical connector mounted on a printed circuit board and including:

a second insulative housing having a second mating port mated with the first mating port;

a plurality of second conductive contacts disposed in the second insulative housing and mechanically and electrically engaged with the corresponding first conductive contacts, respectively;

a second grounding shield assembly enclosing said second insulative housing; wherein said vertical portion of the first grounding shield assembly is releasably retained and engaged with the second grounding shield assembly so as to assure reliable coupling between the first electrical connector and the second electrical connector.

20. The assembly as claimed in claim 19, wherein said second grounding shield assembly includes discrete pulling member and grounding member cooperating with each other to define a space therebetween, and said vertical portion of the first grounding shield assembly is located therebetween.

21. The assembly as claimed in claim 19, wherein said first grounding shield assembly includes discrete pulling member and grounding member.

* * * * *